United States Patent [19]

Kawamura et al.

[11] 4,211,191

[45] Jul. 8, 1980

[54] FUEL SUPPLYING DEVICE FOR INTERNAL COMBUSTION ENGINE

[75] Inventors: Yoshihisa Kawamura, Fujisawa; Masaaki Saito, Yokosuka, both of Japan

[73] Assignee: Nissan Motor Company, Limited, Yokohama, Japan

[21] Appl. No.: 940,096

[22] Filed: Sep. 6, 1978

[30] Foreign Application Priority Data

Oct. 14, 1977 [JP] Japan ..... 52/123757

[51] Int. Cl.[2] ..... F02B 19/10; F02B 75/18

[52] U.S. Cl. ..... 123/52 M; 123/547

[58] Field of Search ..... 123/52 M, 139 AW, 52 R

[56] References Cited

U.S. PATENT DOCUMENTS

| | | | |
|---|---|---|---|
| 1,618,139 | 2/1927 | Ryder | 123/52 M |
| 2,213,683 | 9/1940 | Banning | 123/139 AW |
| 2,702,535 | 2/1955 | Links | 123/139 AW |
| 3,656,464 | 4/1972 | Hilborn | 123/139 AW |
| 3,826,233 | 7/1974 | Mennesson | 123/139 AW |
| 3,890,946 | 6/1975 | Wahl | 123/139 AW |
| 4,034,733 | 7/1977 | Noguchi | 123/139 AW |

FOREIGN PATENT DOCUMENTS

| | | | |
|---|---|---|---|
| 2435840 | 2/1976 | Fed. Rep. of Germany | 123/139 AW |
| 2753678 | 6/1978 | Fed. Rep. of Germany | 123/139 AW |

*Primary Examiner*—Charles J. Myhre
*Assistant Examiner*—Craig R. Feinberg
*Attorney, Agent, or Firm*—Robert E. Burns; Emmanuel J. Lobato; Bruce L. Adams

[57] ABSTRACT

The invention relates to a fuel supplying device for an internal combustion engine. A fuel supplying device for an internal combustion engine includes a fuel injector for injecting fuel into a collector or riser section of an intake manifold from which a plurality of branches extend toward cylinders of the engine. According to the invention, an induction passage is bent or provided with an elbow so that induction air will change its direction toward a heated bottom wall of the riser section before entering the same and the fuel injector is arranged so as to inject fuel toward the bottom wall and radially inwardly into a flow of induction air passing through the induction passage. With this the amount of fuel flowing along the riser walls has been considerably reduced, thus enhancing the response characteristics.

8 Claims, 4 Drawing Figures

FUEL SUPPLYING DEVICE FOR INTERNAL COMBUSTION ENGINE

BACKGROUND OF THE INVENTION

The present invention relates to a fuel supplying device for an internal combustion engine, and more particularly to a fuel supplying device for an internal combustion engine employing a so-called "single point injection" in which a single or a plurality of fuel injection valves or nozzles inject fuel into the inside of a collector section of an intake manifold from which a plurality of branches extend toward cylinders of the engine.

The construction of a conventional "single point injection" type fuel supplying will be described hereinafter in connection with FIG. 1. It comprises an intake manifold 1 including a plurality of branches 2 extending outwardly from a collector or riser section 3 having a bottom wall 4, which serves as a heat exchanger disposed adjacent to or projecting into a riser of the exhaust manifold to be heated thereby. A substantially straight induction passage 5, more particularly, a throttle chamber having mounted therein a throttle valve 6, is connected to the riser section 3 coaxially. A fuel injection valve or nozzle 7 is mounted to the riser section 3 to communicate with the inside thereof at the upper portion of peripheral wall of the riser section 3 so that jet of fuel injected from the fuel injection valve 7 is directed radially inwardly to cross a stream of air flowing into the riser section 3 from the induction passage 5. As the jet of fuel crosses the stream air, the fuel will be atomized to facilitate mixing of the fuel with the air and thus to achieve even distribution of the fuel between the branches 2 leading to the cylinders. The quantity of fuel to be injected per each injection is varied under the control of a control unit (not shown) in response to the output from an air flow sensor (not shown). If a pulse responsive type injection valve is used, it must be actuated to inject fuel twice per each revolution of the engine crankshaft in the case of a 4-cylinder internal combustion engine, while, it must be actuated to inject three times per each revolution of the engine crankshaft in the case of a 6-cylinder intenal combustion engine. With the conventional fuel supplying device in which fuel is injected toward the opposite wall of the riser section 3 to cross a stream of air flowing therethrough, the difficulty encountered is that, during a certain mode of engine operation, a considerable portion of the injected fuel will flow downwardly along the wall of the riser section 3, so that the quantity of fuel actually reaching each of the engine cylinders will be far below that quantity of fuel required by the control unit in response to the output of the air flow sensor. The poor response characteristics of this fuel supplying device becomes particularly significant if used in a so-called "feed back" or "closed loop" control system. The "feed back" control system uses an exhaust sensor provided in the engine exhaust system and a control unit which varies the quantity of fuel to be fed to the engine cylinders in response to the output from the exhaust sensor so as to maintain the air fuel ratio at a preselected level. Therefore, this control system is known as one of effective measures for operating an internal combustion engine provided with a three-way catalytic converter which can perform HC and CO oxidation NOx reduction. However, the response characteristics of the conventional fuel supplying device as described above is so poor that the precise control of the engine with the "feed back" control system is hardly possible.

It will now be apparent from FIG. 2 that response time or characteristics of the single point injection with the fuel injection valve arrangement of the conventional fuel supplying device is slow. This comes from the comparison of a response characteristics curve c of the conventional fuel supplying device shown in FIG. 1 with that a of another fuel supplying device using a carburetor (carburetor induction) and that b of the other fuel supplying device in which fuel is supplied to the engine cylinders from individual fuel injection valves, respectively (EGI).

SUMMARY OF THE INVENTION

It is therefore an object of the present invention to improve response characteristics of a so-called "single point injection" type fuel supplying device for an internal combustion engine.

DESCRIPTION OF THE PREFERRED EMBODIMENTS

Figure 1:
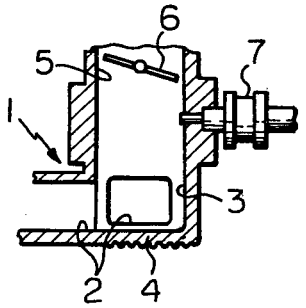
Fig. 1 PRIOR ART
FIG. 1 is a longitudinal sectional view of a conventional fuel supplying device.
Figure 3:
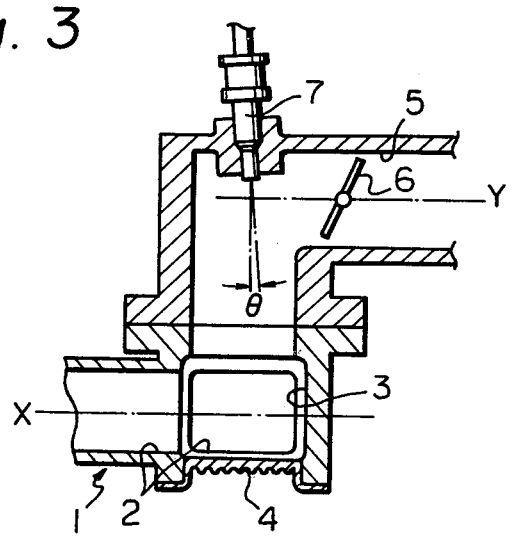
FIG. 3 is a longitudinal sectional view of a first preferred embodiment of a fuel supplying device according to the invention.

Referring to FIG. 3, in which the same reference numerals as in FIG. 1 are used to designate similar parts, each of a plurality of branches 2 extends outwardly from the lower end portion of a collector or riser section 3 and an induction passage 1 leads to the upper end portion of the riser section 3. They are arranged in such a manner that the longitudinal axis X of each branch of all and the longitudinal axis of the induction passage 1 are offset. A fuel injection valve 7 is mounted to the wall of the induction passage 1 within an area disposed generally above the center of the collector section 3 and is directed toward the bottom wall of the riser portion of the collector section 3 so that the jet of fuel is directed radially into the center of a stream of air flowing through the horizontally extending induction passage 1. The angle of the elbow in the induction passage 1 is in this case 90 degrees, in this embodiment. However, the angle may be of any value within the range between 60 degrees and 90 degrees, if desired. The fuel injection valve 7 is angled so that the fuel from the valve 7 will jet downwardly through the central portion of the riser section 3 even if the jet of fuel is deflected by the air in the inflow direction of air toward the adjacent wall. This angle $\Theta$ is chosen by taking into consideration, the injection speed of fuel from the fuel injection valve 7 and the inflow speed of air flowing through the induction passage 1. This angle, as measured from the mounting axis of the fuel injection valve 7, may be within the range from 0 to 20 degrees, and preferably is 5 degrees.

With the injection valve 7 angled at 5 degrees it was confirmed experimentarily that during the whole operating conditions of the engine the fuel injected will flow through the center of the riser section 3.

With the construction precedingly described, since fuel is injected from the fuel injection valve 7 radially inwardly into the stream of air passing through the air induction passage 5 in such a manner as to cross the stream, the jet of fuel will collide with the air stream, thus facilitating the atomization of the fuel and mixing of the fuel with the air. Since considering the deflection effect of the jet of injected fuel by the air stream the fuel injection valve is inclined properly, and the fuel injection valve is disposed over the inlet end of the riser 3, the injected fuel will flow axially through the center portion of the riser section 3 without any contact with the riser walls. Therefore, the phenomena that the fuel adheres to and flows along downwardly along the riser wall, which was the case in the conventional fuel supplying device shown in FIG. 1, has been eliminated or suppressed in the fuel supplying device according to the invention. It will be understood that with the fuel supplying device of the invention the fuel can be evenly distributed between the engine cylinders with the required quantity which is determined by the control unit.

Figure 2:
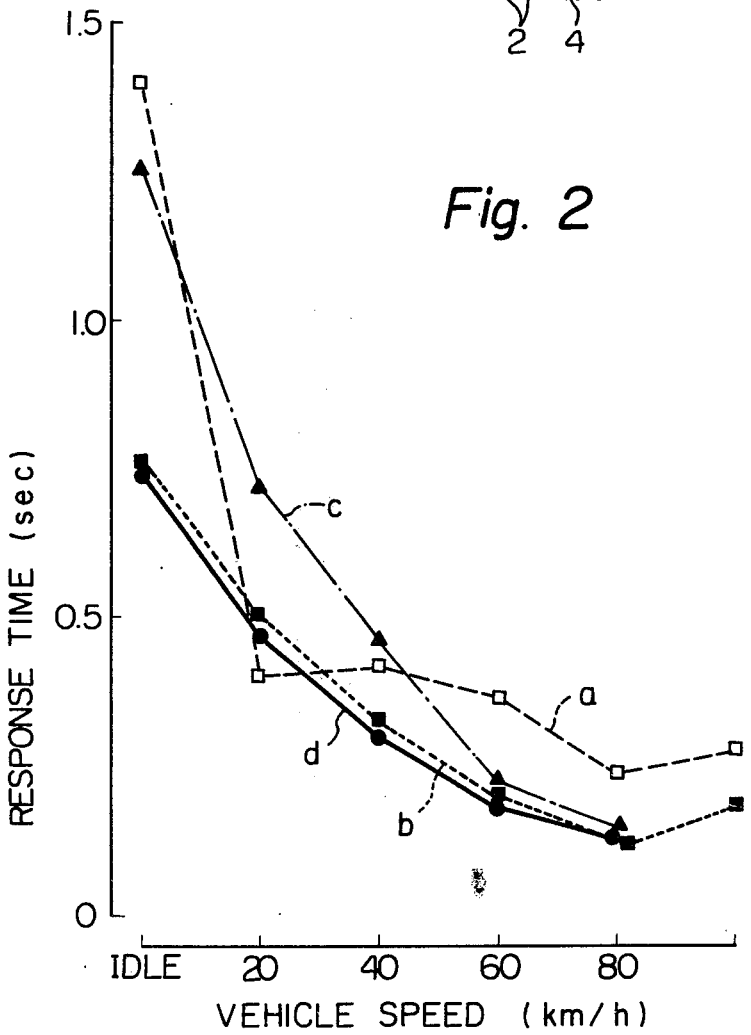
FIG. 2 is a graph showing response characteristics curves of the fuel supplying device shown in FIG. 1 (curve c), of a fuel supplying device using a carburetor (curve a), of a fuel supplying device in which fuel is injected to cylinders from individual fuel injection valves, respectively (curve b) and of a fuel supplying device according to the invention (curve d)

Curve d in FIG. 2 shows the response characteristics of the fuel supplying device according to the invention. From this curve it will be understood that according to the invention, the response characteristics has been improved as compared with curve c obtained by the conventional fuel supplying device shown in FIG. 1 and is as good as the curve b obtained by EGI in which each cylinder is supplied fuel from each independent fuel injection valve.

Figure 4:
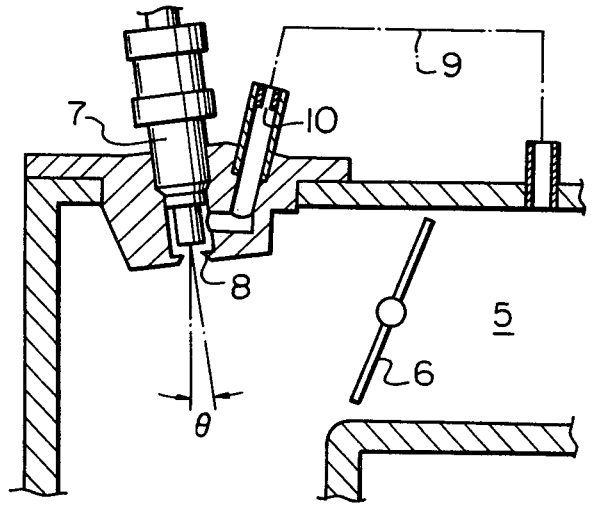
FIG. 4 is a fragmentary enlarged sectional view of a second preferred embodiment of a fuel supplying device according to the invention.

Referring to FIG. 4 embodiment, a bypass passage 9 leads from a portion upstream of the throttle vale 6 to a port provided adjacent the fuel port 8 from which the fuel is injected into the air stream, so as to introduce air upstream of the throttle valve 6 into the downstream of the throttle valve 6 through the fuel port 8. An orifice 10 is provided in the bypass passage 9 which has been so selected that the amount of air passing through the bypass passage 9 is smaller than the amount of induction air upon idling of the engine.

In operation, due to the pressure difference between both ends of the bypass 9 air will be injected toward the jet of fuel injected from the fuel injection valve 7 at a speed approximately as high as the sonic speed, thus further facilitating the atomization of fuel. Thus, with this construction shown in FIG. 4 the improvement in mixing of the fuel with the air has been considerable.

What is claimed is:

1. In an internal combustion engine having a combustion chamber means defining an air induction passageway leading to said combustion chamber, said induction passageway including an upstream portion having a first longitudinal axis and a downstream portion having a second longitudinal axis, said upstream portion and said downstream portion interconnecting at a first predetermined angle to define an elbow;

a fuel injector disposed in said elbow to inject a jet of fuel through said downstream portion in the direction of said combustion chamber, said injector being oriented to inject said jet of fuel at a second predetermined angle with respect to said second longitudinal axis which is directed back toward said upstream portion so that the flow of air entering said downstream portion from said upstream portion tends to deflect said jet of fuel so that it tends to follow said second longitudinal axis and substantially none of the fuel impinges on the walls of said downstream portion.

2. An internal combustion engine as claimed in claim 1, wherein said first angle is between 60 to 90 degrees inclusive.

3. An internal combustion engine as claimed in claim 1, wherein said second angle is between 0 and 20 degrees inclusive.

4. An internal combustion engine as claimed in claim 1, further comprising a throttle valve disposed in said upstream portion and a bypass leading from upstream of said throttle valve to said injector.

5. A fuel supplying device for an internal combustion engine comprising:

an intake manifold having a riser section and a plurality of branches extending outwardly from said riser section, said riser section having a bottom wall and an inlet port disposed above said bottom wall;

means defining an induction passage, said induction passage having a throttle valve therein and being connected to said inlet port of said riser section, said induction passage having an elbow so that air to be inducted by said engine will change its direction toward said bottom wall before entering said riser section, and fuel injection means disposed in said elbow for injecting fuel toward said bottom wall and radially inwardly into a flow of air passing through said induction passage, said fuel injection means being so inclined as to direct the jet of fuel back against the flow of air passing through said induction passage.

6. A fuel supplying device as claimed in claim 5 further comprising:

means defining a bypass passage through which a portion of air upstream of said throttle valve passes toward an area adjacent a port through which jet of fuel injected from said fuel injection means will pass.

7. In an internal combustion engine having a plurality of combustion chambers an intake manifold having a riser section and a plurality of branches extending outwardly from said riser to the plurality of combustion chambers, respectively, said riser section having a bottom wall and an inlet port disposed above said bottom wall;

means defining an induction passage, said induction passage having a throttle valve therein and being connected to said inlet port of said riser section, said induction passage having an elbow so that air to be inducted by the engine will change its direction toward said bottom wall before entering said riser section, and fuel injection means disposed in said elbow for injecting fuel toward said bottom wall and radially inwardly into a flow of air passing through said induction passage, said fuel injection means being so inclined as to direct the jet of fuel back against the flow of air passing through said induction passage.

8. An internal combustion engine as claimed in claim 7, further comprising:

means defining a bypass passage which leads from upstream in said induction passage of said throttle valve to said fuel injection means so that a portion of air upstream of said throttle valve passes toward an area adjacent to a port through which jet of fuel from said fuel injection means will pass.

* * * * *